US005659900A

United States Patent [19]

Arney et al.

[11] Patent Number: 5,659,900

[45] Date of Patent: Aug. 26, 1997

[54] SIZING AND STABILIZING APPARATUS FOR BICYCLE HELMETS

[75] Inventors: Michel D. Arney, Needham; Andrew G. Ziegler, Arlington, both of Mass.

[73] Assignee: Bell Sports, Inc., Scottsdale, Ariz.

[21] Appl. No.: 88,878

[22] Filed: Jul. 8, 1993

[51] Int. Cl.[6] ..... A42B 3/04

[52] U.S. Cl. ..... 2/417; 2/181; 2/181.2; 2/181.4; 2/183; 2/418; 2/421; 2/425; 2/909

[58] Field of Search ..... 2/5, 6.1, 6.6, 181, 2/181.2, 181.4, 183, 410, 411, 415, 416, 417, 418, 419, 420, 421, 425, 909, 918; 128/644

[56] References Cited

U.S. PATENT DOCUMENTS

| | | | |
|---|---|---|---|
| 1,522,024 | 1/1925 | Nixon, Jr. . | |
| 1,537,178 | 5/1925 | Maynard | 2/421 |
| 2,739,310 | 3/1956 | Frieder et al. | 2/418 |
| 3,087,166 | 4/1963 | Howard | 2/3 |
| 3,130,415 | 4/1964 | Colley | 2/415 |
| 3,139,623 | 7/1964 | Joseph, Jr. | 2/415 |
| 3,171,133 | 3/1965 | Steffen | 2/3 |
| 3,230,544 | 1/1966 | Mager | 2/415 |
| 3,323,134 | 6/1967 | Swyers | 2/421 |
| 3,354,468 | 11/1967 | Bowers | 2/421 |
| 3,388,405 | 6/1968 | Simpson et al. | 2/418 |
| 3,591,863 | 7/1971 | Rickard | 2/421 |
| 3,852,821 | 12/1974 | Mickel | 2/421 |
| 3,925,821 | 12/1975 | Lewicki | 2/425 |
| 3,934,271 | 1/1976 | Rhee | 2/3 |
| 3,991,423 | 11/1976 | Jones | 2/415 |
| 3,992,722 | 11/1976 | Rhee | 4/424 |
| 4,000,520 | 1/1977 | Svendsen et al. | 2/418 |
| 4,011,600 | 3/1977 | Malk | 2/183 |
| 4,058,854 | 11/1977 | Rhee | 2/412 |
| 4,068,323 | 1/1978 | Gwon | 2/413 |
| 4,075,715 | 2/1978 | Cowgill | 2/421 |
| 4,263,679 | 4/1981 | Erlendson | 2/421 |
| 4,274,157 | 6/1981 | Boden | 2/181 |
| 4,279,038 | 7/1981 | Bruckner et al. | 2/425 |
| 4,477,929 | 10/1984 | Mattsson | 2/425 |
| 4,534,068 | 8/1985 | Mitchell et al. | 2/414 |
| 4,642,817 | 2/1987 | Ferstenfeld | 2/183 |
| 4,845,782 | 7/1989 | Gregg | 2/172 |
| 4,884,301 | 12/1989 | Aileo | 2/909 |
| 4,993,079 | 2/1991 | Johnson | 2/181 |
| 5,012,533 | 5/1991 | Raffler | 2/420 |
| 5,023,958 | 6/1991 | Rotzin | 2/421 |
| 5,079,780 | 1/1992 | Coombs et al. | 2/909 |
| 5,083,320 | 1/1992 | Halstead | 2/413 |
| 5,121,508 | 6/1992 | Grilliot et al. | 2/421 |
| 5,129,108 | 7/1992 | Copeland et al. | 2/424 |
| 5,142,705 | 9/1992 | Edwards | 2/418 |
| 5,168,576 | 12/1992 | Krent et al. | 2/2 |
| 5,315,718 | 5/1994 | Barson et al. | 2/421 |
| 5,333,328 | 8/1994 | Roberts | 2/422 |
| 5,381,560 | 1/1995 | Halstead | 2/421 |

FOREIGN PATENT DOCUMENTS

| | | | |
|---|---|---|---|
| 36 32 525 A1 | 9/1986 | Germany . | |
| 172388 | 11/1969 | United Kingdom | 2/421 |

*Primary Examiner*—Diana Biefeld

*Attorney, Agent, or Firm*—Limbach & Limbach; George C. Limbach

[57] ABSTRACT

A bicycle helmet is disclosed having a flexible, articulated member depending from the rear of the helmet, providing a closer fit to an individual wearer's head and improving stability of the helmet on the head, particularly for mountain bike riding. The articulated member contacts the wearer's head beneath the occipital region and applies a forward and upward pressure against the head. The general embodiment of the invention includes an elastic strap stretching from one side of the helmet, across the back of the articulated member, to the opposite side of the helmet. Adjusting this strap allows the wearer to adjust the forward and upward pressure exerted by the articulated member on the wearer's head.

11 Claims, 13 Drawing Sheets

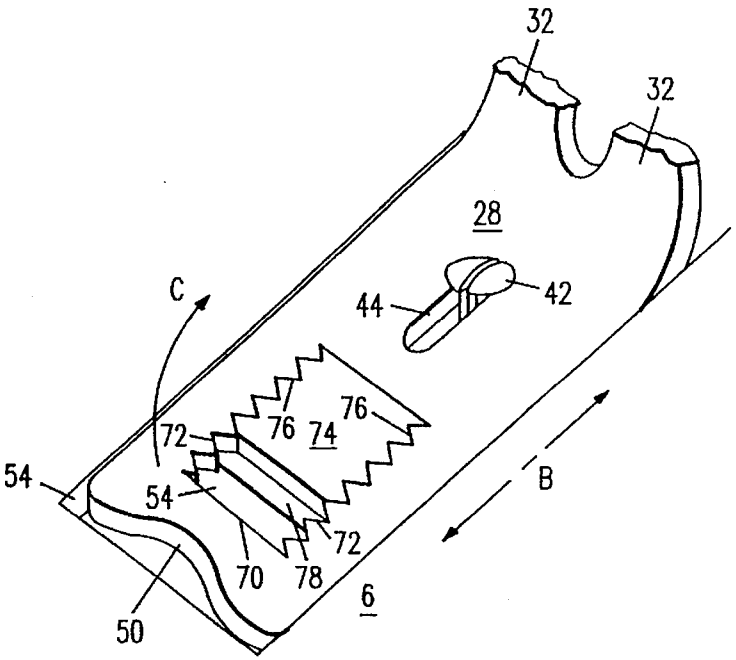
FIG. 12b
FIG. 12a
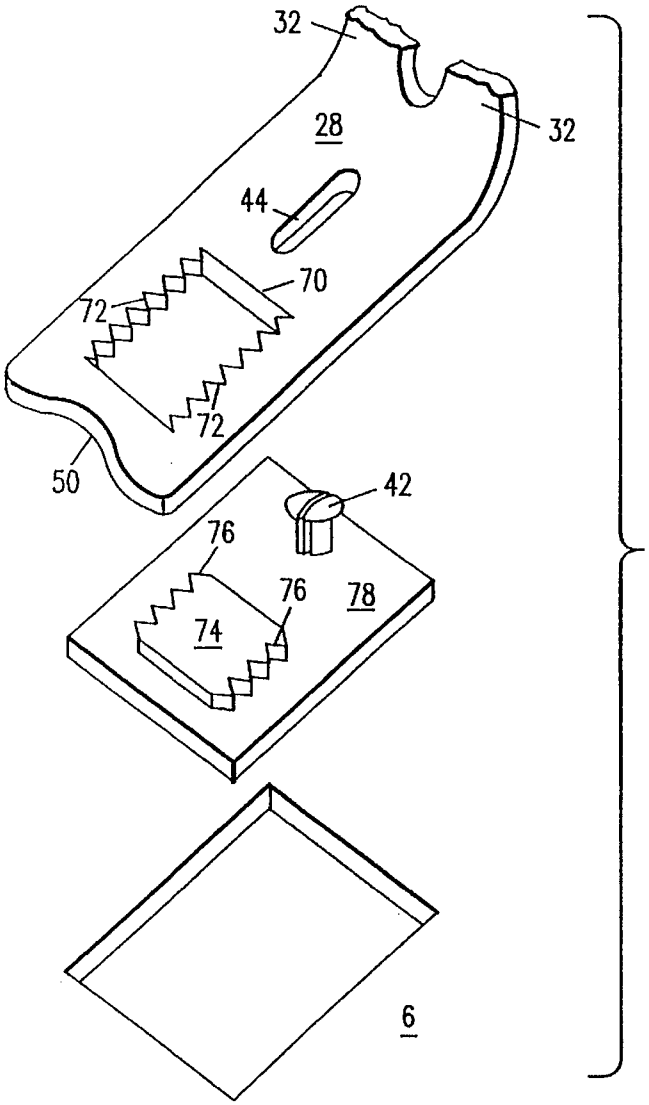

SIZING AND STABILIZING APPARATUS FOR BICYCLE HELMETS

BACKGROUND OF THE INVENTION

1. Field of the Invention

The present invention relates to bicycle helmets, in particular to sizing and stabilizing a mountain bike helmet on a rider's head.

2. Discussion of the Prior Art

Lightweight helmets for head protection during bicycle riding falls and accidents have continuously evolved and undergone numerous improvements in recent years. One particular area of refinement has been in the fitting and stabilizing of helmets on the bicycle rider's head. An example of a prior art bicycle helmet and a means for securing it from excessive movement is disclosed in U.S. Pat. No. 4,903,350.

In order to fit a variety of head shapes and sizes, a particular brand of helmet often will be available in several sizes. Each size typically can be customized to a particular wearer's head by inserting or removing cushions and pads around the interior of the helmet cavity to obtain a snug fit.

Chin straps are employed no keep the helmet on. These straps reduce the vertical movement of the helmet relative to the wearer's head, but provide little resistance to the forward and back rocking motion of the helmet. Many helmet models now employ chin straps having a "Y" configuration on each side. A loop is attached to the front and rear of each side of the helmet, and these two loops are connected by a strap beneath the wearer's chin. An example of this type of prior art helmet and strap arrangement is also disclosed by U.S. Pat. No. 4,903,350. While this type of chin strap reduces the amount of helmet movement, it does not eliminate it.

The sport of mountain bike riding has grown increasingly popular in recent years. This activity involves riding specially designed bicycles with heavy duty frames and components on unpaved roads, trails and rough terrain. Experienced mountain bike riders can travel over steep drops, uneven terrain, boulders, stumps, logs, creek beds, and such while on their mountain bikes. Conventional bicycle helmets are typically used for protection from falls. The bouncing, bumping and jarring associated with mountain bike riding greatly exacerbates the problem of excessive helmet movement on the rider's head. Bike riders traveling on dirt roads or even city streets will often experience these problems. A tightly fitted helmet with a taut chin strap may reduce the amount of movement of the helmet on the wearer's head, but usually provides more of a discomfort than a solution to the problem.

Prior art bicycle helmets have not utilized the undercut portion beneath the occipital region of the wearer's head to stabilize the helmet. There are two apparent reasons for this. The first is that the process used to mold a one piece main shell of the helmet can not tolerate a negative draft angle without prohibitively expensive multi-part molds to allow removal of the helmet after molding. The second reason concerns the difficulty or impossibility of the wearer fitting the helmet over his or her head if the helmet contains a substantial inward curve to match the undercut portion of the back of the head.

SUMMARY OF THE INVENTION

Broadly stated, the present invention, to be described in greater detail below, is directed to a bicycle helmet having an articulated member for engaging the head of the wearer.

In accordance with one aspect of the present invention, an articulated member is biased against the occipital region of the wearer's head, allowing the helmet to more closely fit a larger range of head sizes and shapes.

In accordance with another aspect of the present invention, the occipital region of the wearer's head is elastically retained between a rear articulated member and the inside of the main shell portion of the helmet. Because the occipital region is cradled from both above and below, the helmet is comfortably secured and movement of the helmet on the wearer's head is greatly reduced or eliminated.

FIG. **9*a* and 9*b*** are perspective views showing a sliding adjustment and locking feature for the articulated member of an alternative embodiment.

Figure 10:
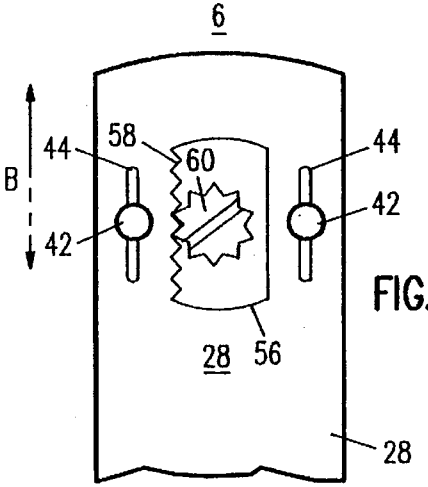

FIG. 10 is a perspective view showing a sliding adjustment and locking feature for the articulated member of an alternative embodiment.

Figure 11:
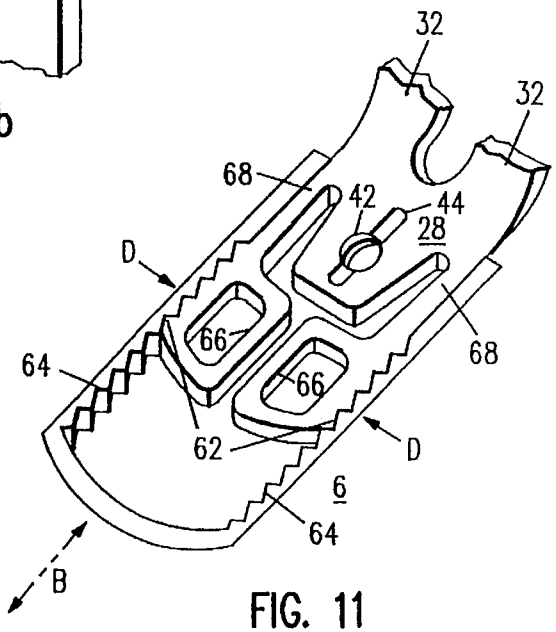

FIG. 11 is a perspective view showing a sliding adjustment and locking feature for the articulated member of an alternative embodiment.

FIG. **12*a* and 12*b*** are perspective views showing a sliding adjustment and locking feature for the articulated member of an alternative embodiment.

FIG. **13*a* and 13*b*** are perspective views showing a sliding adjustment and locking feature for the articulated member of an alternative embodiment.

FIG. **14*a* and 14*b*** are perspective views showing a sliding adjustment and locking feature for the articulated member of an alternative embodiment.

Figure 15:
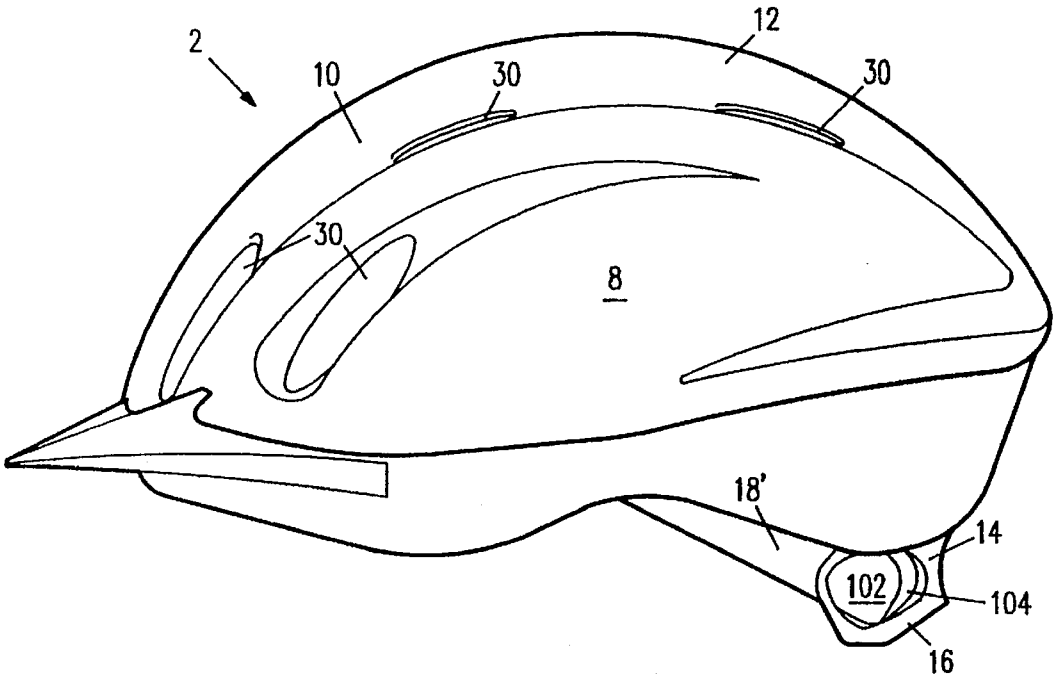

FIG. 15 is a side elevation view showing the preferred embodiment of the inventive helmet.

Figure 16:
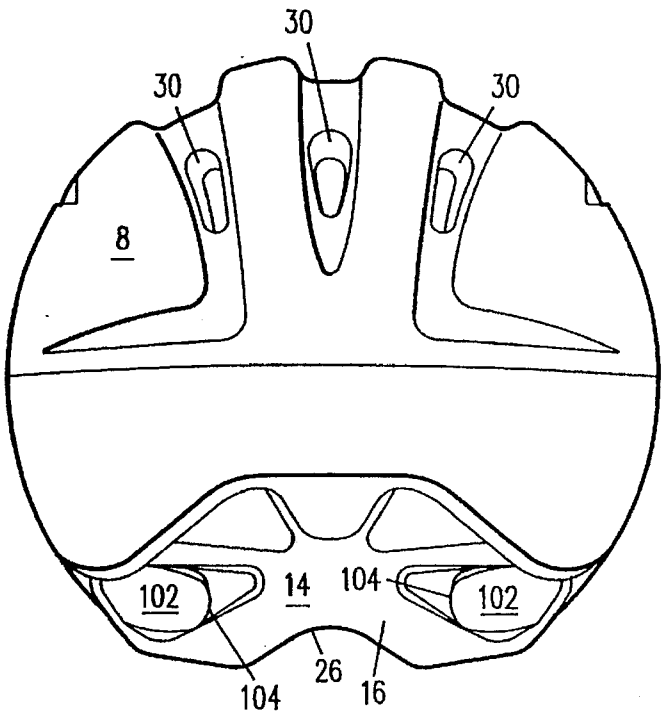

FIG. 16 is a rear elevation view showing the preferred embodiment of the inventive helmet.

Figure 17B:
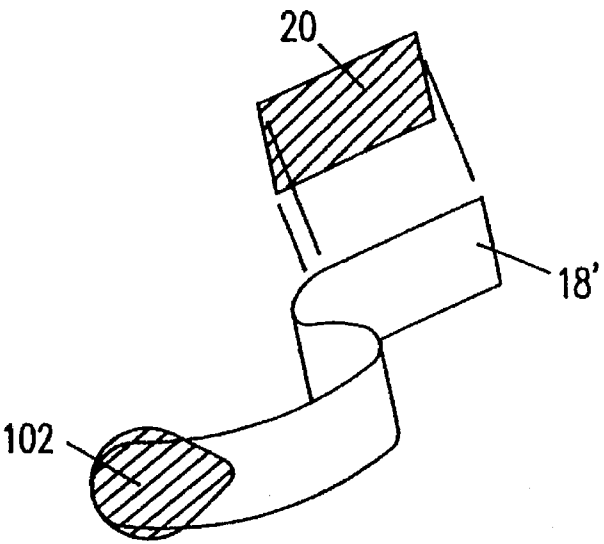
Figure 17A:
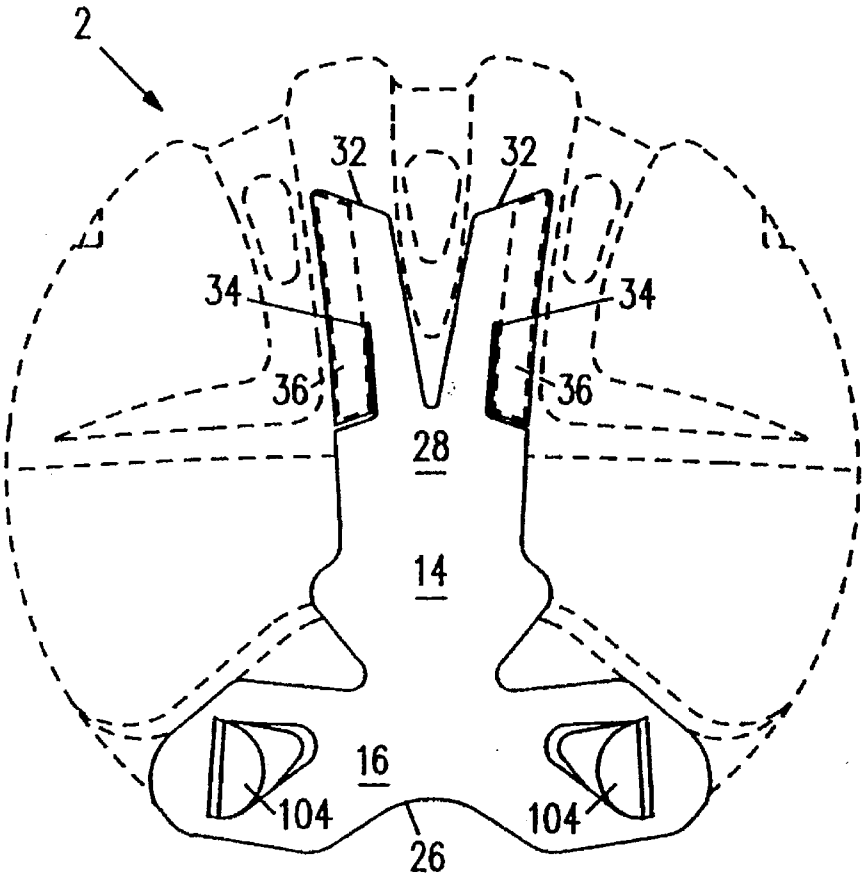

FIG. 17 is a rear elevation view showing the preferred embodiment of the articulated member.

DETAILED DESCRIPTION OF THE PREFERRED EMBODIMENTS

Figure 1:
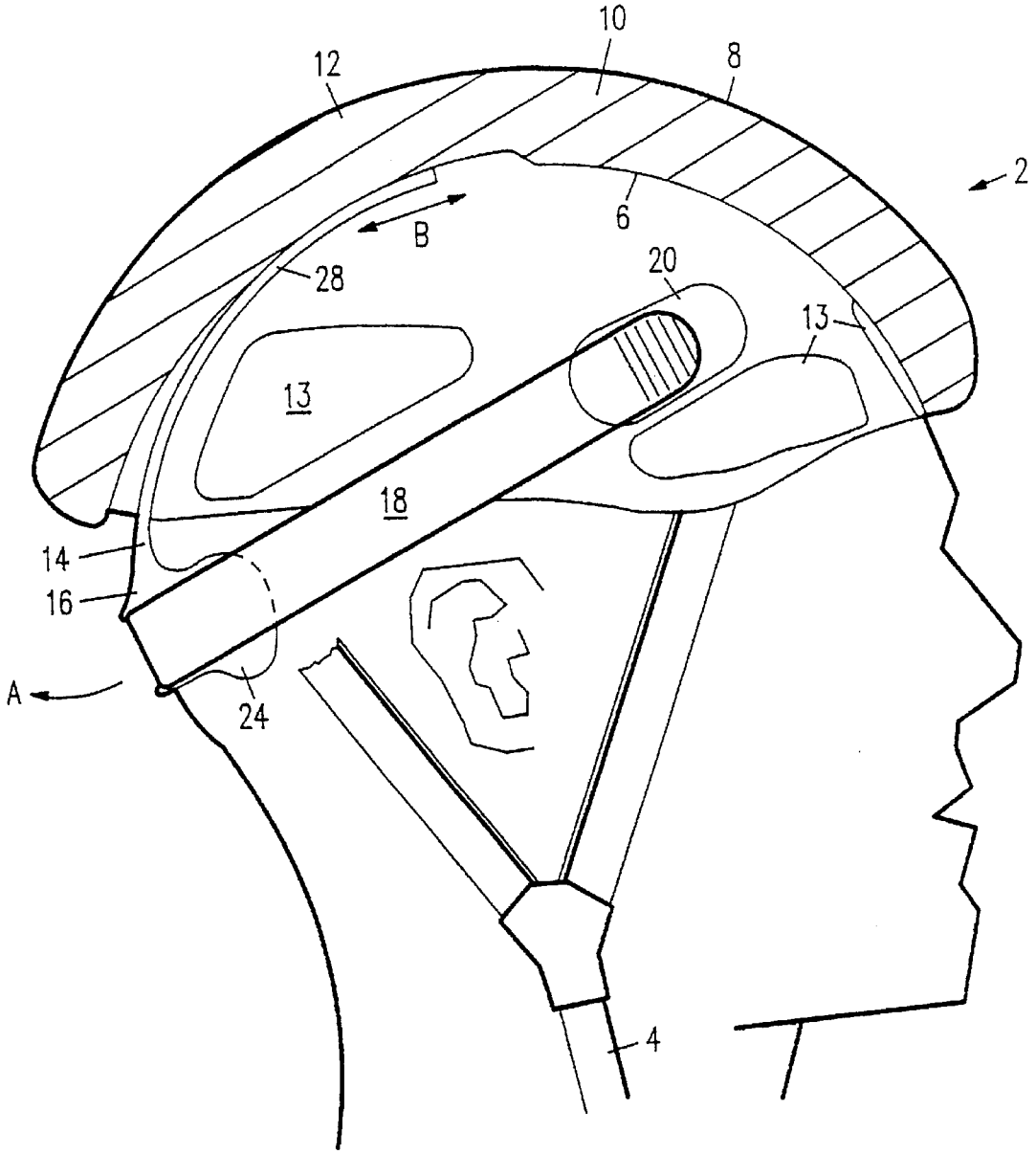
FIG. 1 is a fragmentary side elevation view showing a general embodiment of the inventive helmet.

Referring to FIG. 1, in which the general embodiment of the present invention is shown, the main shell 2 of the helmet is secured to the wearer's head by a chin strap 4. The main shell 2 has an interior surface 6 defining a helmet cavity for receiving the wearer's head, and an exterior surface 8. The helmet can be further defined by a top portion fitting over the top of the head of a wearer and with a front half 10 and a rear half 12. Removable pads 13 are attached to the interior surface 6 of main shell 2 for obtaining a proper fit for a particular wearer A flexible articulated member 14 has its proximal end 28 attached to the central top interior 6 of the top portion of the main shell 2 forward of the back of the neck of a wearer near the front of the shell rear half 10 and extends downward and inward, generally along the interior surface 6 of the rear half 12 and extending beyond the lower edge of the helmet to its distal end 16. From the proximal end 28 to the distal end 16 the articulated member 14 is in the form of an arcuate arm. In the general embodiment, when the articulated member 14 is in a relaxed state when the helmet is not being worn, articulated member 14 curves inward more than shown in FIG. 1. As the helmet is placed on the wearer's head, articulated member 14 flexes rearward in the direction of arrow A to accommodate the head, then returns partially forward underneath the occipital region of the head when the helmet is all the way on. The flexing portion of the articulated member 14 essentially forms a hinge that allows the wearer to flex the articulated member back to allow the helmet to fit over the wearer's head. Once the helmet is on, the articulated member 14 flexes forward again to contact the back of the head. Because articulated member 14 is being displaced when worn, it exerts a forward pressure on the back of the head. The flexed portion of the displaced articulated arm 14 acts as a spring to exert the forward pressure on the back of the head. This forward pressure provides a snug yet comfortable fit which greatly increases the stability of the helmet. Because the occipital region of the wearer's head is cradled from below by the articulated member 14, the helmet is restrained from rocking forward and back, and from bouncing around on the wearer's head.

Figure 2:
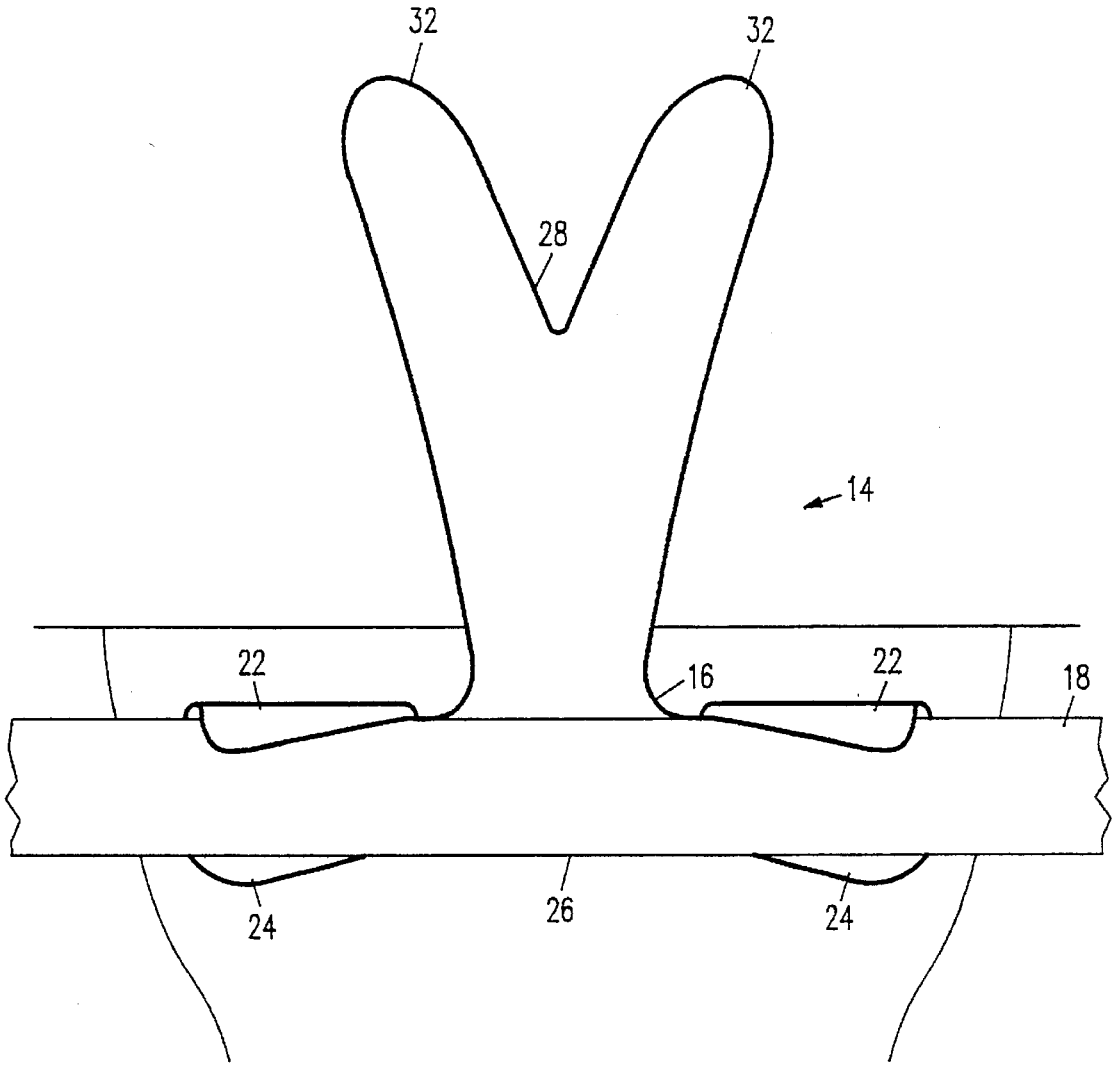
FIG. 2 is a rear elevation view showing the articulated member of a general embodiment.

FIG. 2 shows the cross bar or T-shaped distal end 16 of articulated member 14. The cross bar or distal end 16 of the articulated member 14 is also curved in a lateral direction. The curvature in this direction is designed to approximate the curvature of the corresponding portion of the wearer's head, and if necessary, to flex in the lateral direction to accommodate the head.

An elastic strap 18 is provided to increase, and preferably also to adjust, the forward pressure exerted by the flexed articulated member 14 against the back of the user's head. In the general embodiment shown in FIGS. 1 and 2, a one piece strap 18 is attached at both its ends to the interior 6 of the sides of the main shell 2. The middle portion of strap 18 is guided across the back of the distal end 16 of articulated member 14. When the helmet is worn, strap 18 stretches, thereby adding to the forward flexing force of the articulated member 14. The location of the attachment points on the main shell 2 is such that the strap 18 biases the distal end 16 of articulated member 14 upward and inward against the inwardly curving portion of the occipital region of the wearer's head.

In the general embodiment, strap 18 is attached at both ends to the main shell 2 with hook and loop type fasteners. The preferred embodiment uses VELCRO® hook and loop type fasteners. A small patch 20 of the hook portion of the fastener is bonded to each side of the main shell 2 on the interior surface 6 just above and forward of the wearer's ears. The entire strap 18 is made from an elastic fabric with a nap suitable for releasably adhering to patches 20 inside the main shell 2. The forward and upward tension that the strap 18 imparts to the wearer's head through the articulated member 14 can be increased or decreased by moving one or both ends of the strap 18 forward or back, respectively, in relation to the patches 20. This is done with the helmet off in the general embodiment. Alternatively, one end of the strap 18 can be made adjustable, with the other end being fixed.

Figure 6:
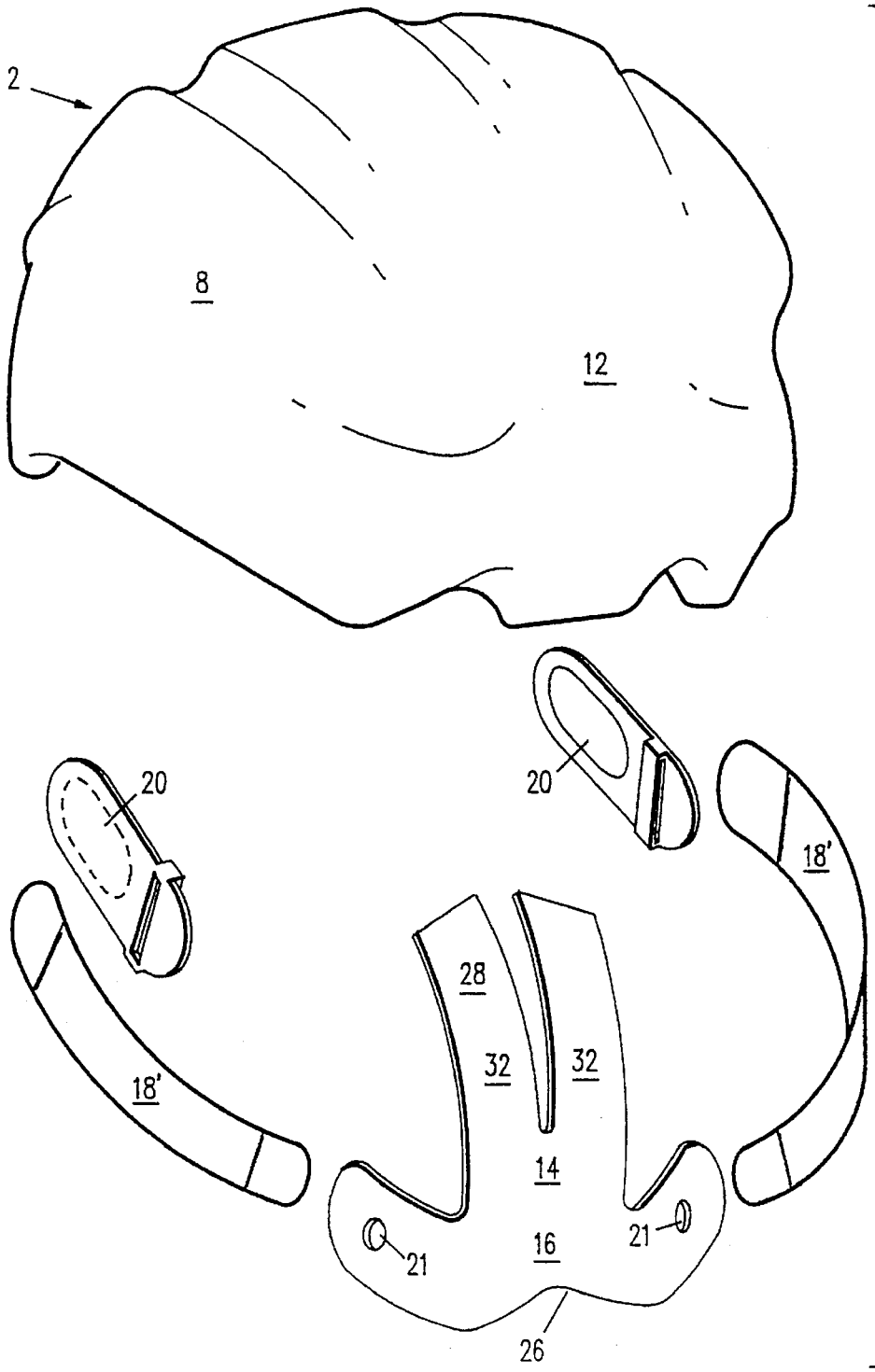
FIG. 6 is an exploded rear perspective view showing an alternate embodiment.

In an alternative embodiment, shown in FIG. 6, two straps 18' can be used, with each strap 18' spanning between one side of the distal end 16 of the articulated member 14 and the adjacent side of the main shell 2. The straps 18' can be attached with snaps 21 to the distal end 16 of the articulated member 14. The opposite ends of straps 18' are then adjustably attached to the main shell 2 in a similar manner to that previously described. In another variation of the two strap embodiment (not shown), one end of each strap is attached to the inside of the helmet, while the other end is adjustably attached to the distal end 16 of the articulated member 14, allowing the strap tension to be adjusted while the helmet is being worn.

Figure 5:
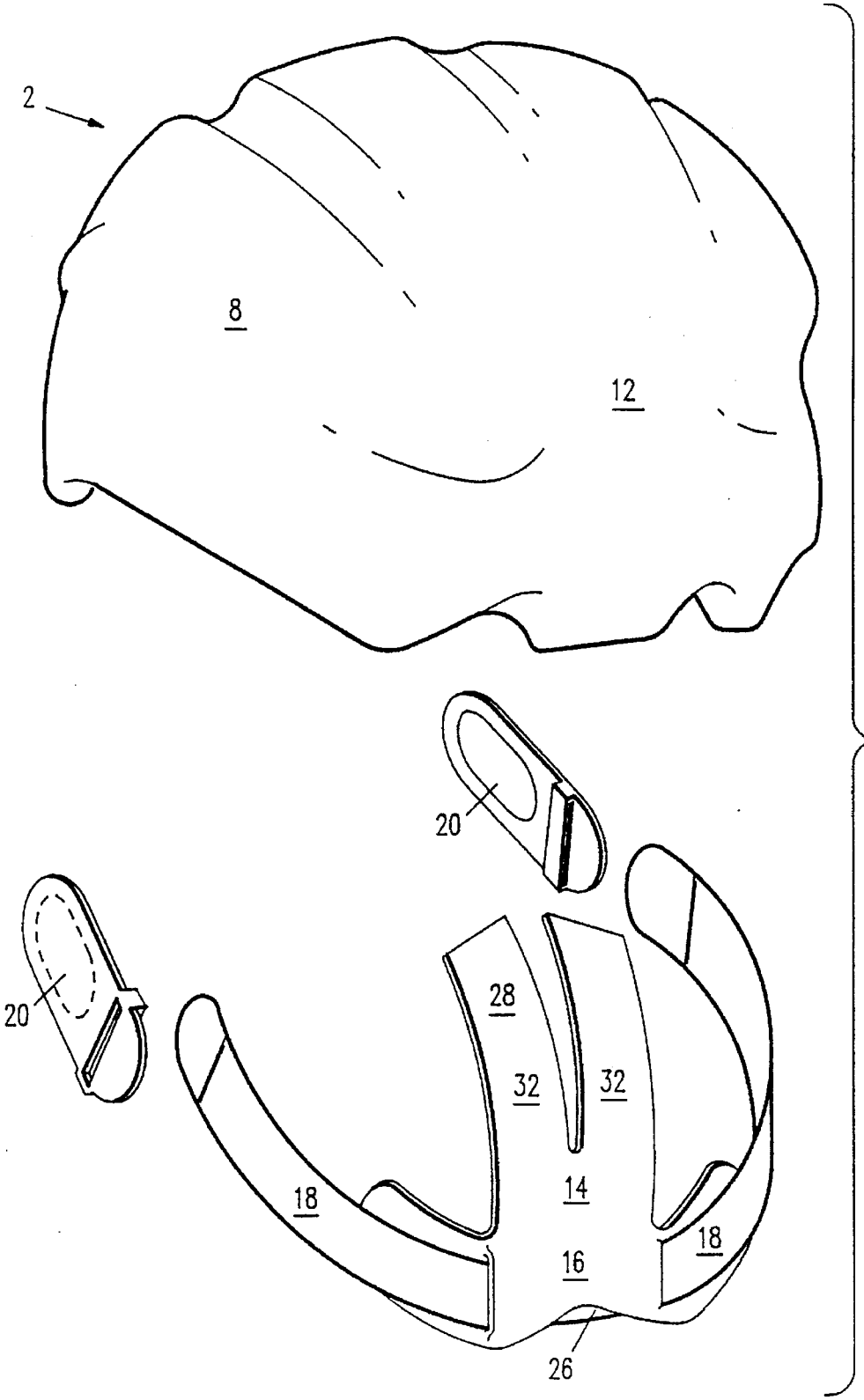
FIG. 5 is an exploded rear perspective view showing an alternate embodiment.
Figure 7:
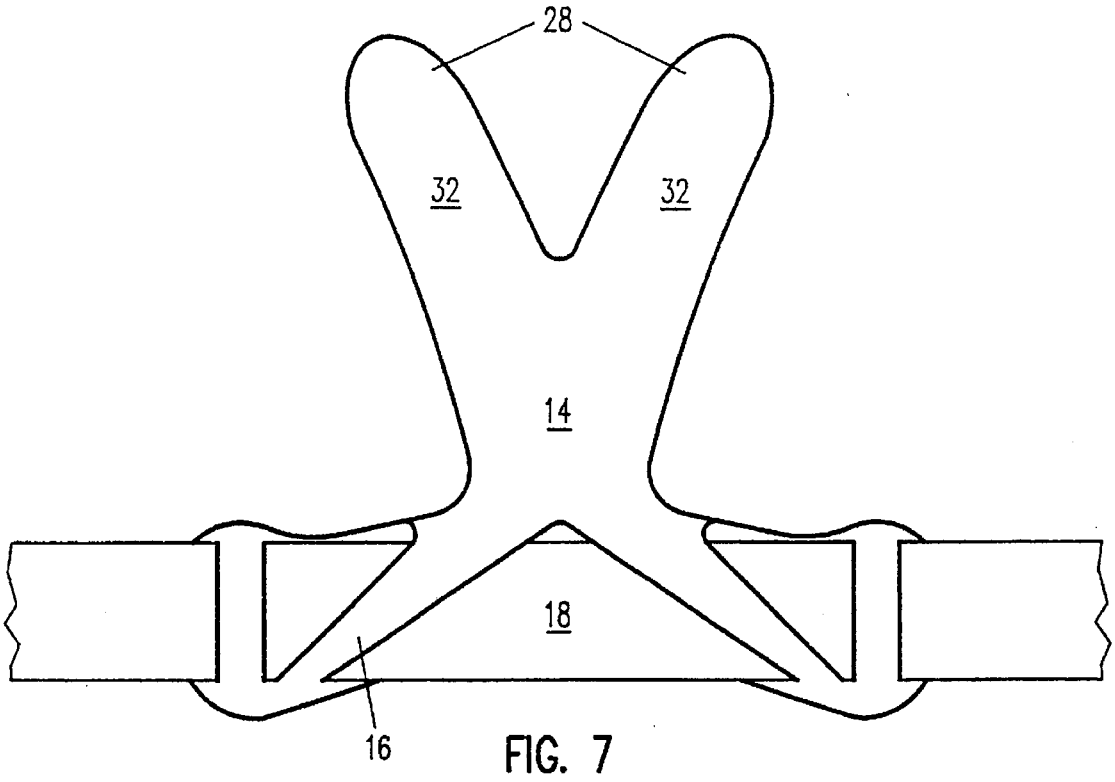
FIG. 7 is a rear elevation view showing the articulated member of an alternate embodiment.
Figure 8:
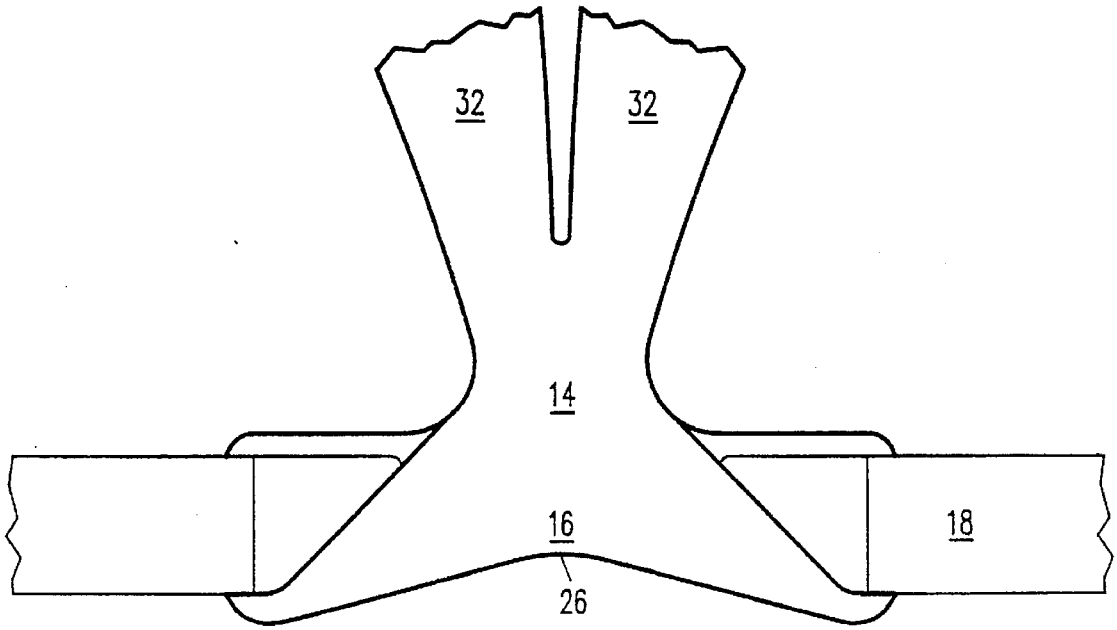
FIG. 8 is a rear elevation view showing the articulated member of an alternate embodiment.

In the general embodiment shown in FIG. 2, inverted J-shaped hold downs 22 are provided on the upper outside ends of the T-shaped distal end 16 of the articulated member 14. These hold downs 22 capture the upper edge of strap 18 and prevent it from sliding upwards and off the T-shaped distal end 16 of the articulated member 14. Similarly, outward bends 24 are provided near the lower edge of articulated member 14 to inhibit strap 18 from sliding off the bottom of articulated member 14. In alternative embodiments, strap 18 can be captivated by clips or guide slots in the distal end 16 of the articulated member 14, as shown in FIGS. 5, 7 and 8.

As shown in FIGS. 1 and 2, outward bends 24 also serve to comfortably guide the leading edge (lower edge) of the articulated member 14 over the head when the wearer puts the helmet on. Recess 26 is provided at the lower edge of the articulated member 14 to accommodate the wearer's neck (or hair, such as when worn in a ponytail) when the wearer is in a forward leaning, bicycle riding position. Recess 26 and outward bends 24 allow articulated member 14 to comfortably exert a constant forward and upward pressure on the occipital region of the wearer's head without binding or digging in, regardless of the front to back tilt of the wearer's head.

Figure 3:
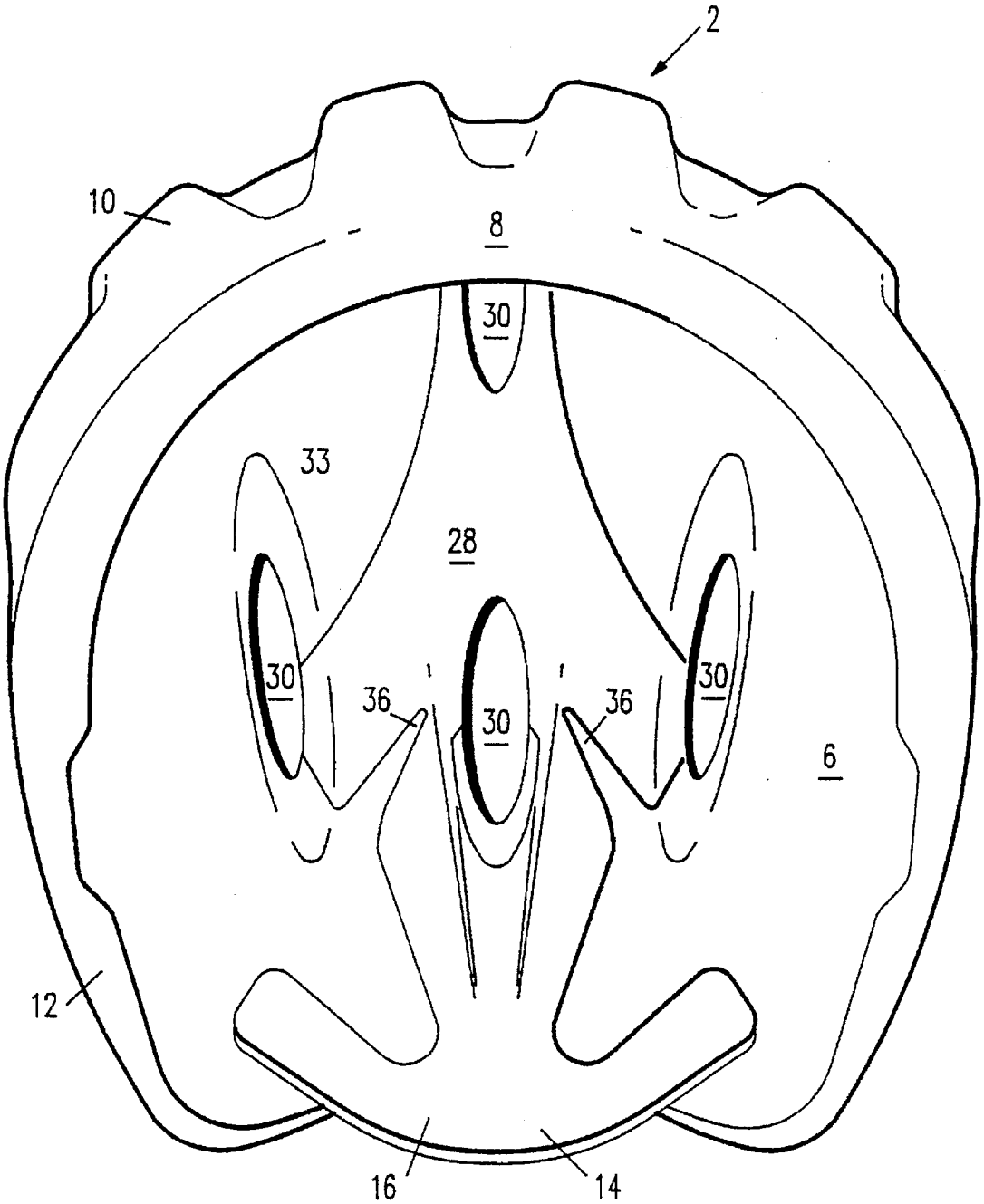
FIG. 3 is a lower frontal view showing the articulated member up inside the main shell in an alternative embodiment.

In the general embodiment, as shown in FIG. 2, the proximal end 28 of the articulated member 14 is forked so that it can be securely mounted to the interior 6 of the main shell 2 without interfering with the air flow through the air vents 30. Both tines 32 of proximal end 28 of articulated member 14 are attached to the interior 6 of the main shell 2 with fasteners or adhesive. Air vents 30 in the main shell 2 can be utilized to secure complementary tabs 33 on the articulated member 14, as shown in FIG. 3.

Figure 4:
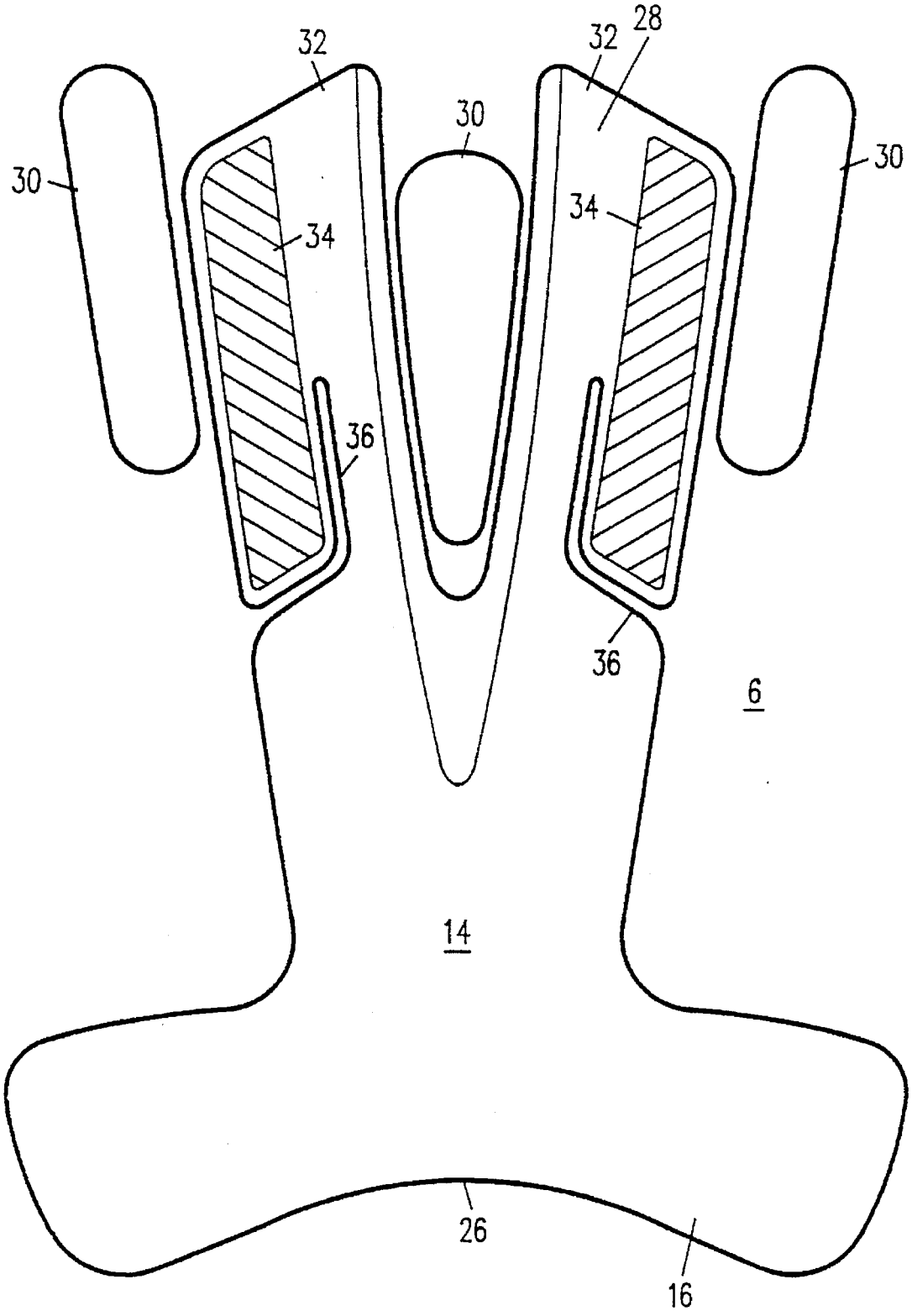
FIG. 4 is an enlarged, partial bottom view showing the articulated member in an alternative embodiment.

In an alternative embodiment shown in FIG. 4, the proximal end 28 of articulated member 14 is attached to the main shell 2 with an adhesive tape 34. Adhesive tapes offer excellent bonding strength when in tension, but are susceptible to peeling off when force is concentrated on one corner or edge. Reliefs 36 which are elongated cutouts in the articulated member 14, are provided in the proximal end 28 of the articulated member 14 to more centrally locate the force which is applied to the adhesive tape 34 when the articulated member 14 is flexed. This arrangement more evenly distributes the forces that would tend to separate the articulated member 14 from the main shell 2. Without the reliefs 36, articulated member 14 might be peeled off the main shell 2 by pushing the articulated member 14 forward, or from cycling back and forth due to prolonged use. The reliefs 36, however, ensure that the articulated member 14 remains adhered to the main shell 2 because the adhesive tape 34 is exposed to mostly tensile stress and low peel stress.

As shown in FIG. 1, an alternative embodiment can include the ability to adjust articulated member 14 in the direction of arrow B. The articulated member 14 can be slidably mounted to main shell 2 to allow the position of the member to be adjusted to a particular wearer's head. Several concepts to allow sliding movement and releasably locking in position are illustrated in FIGS. 9 through 14.

Figure 9B:
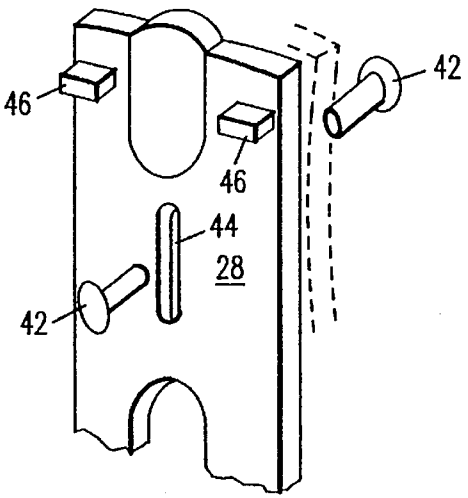
Figure 9A:
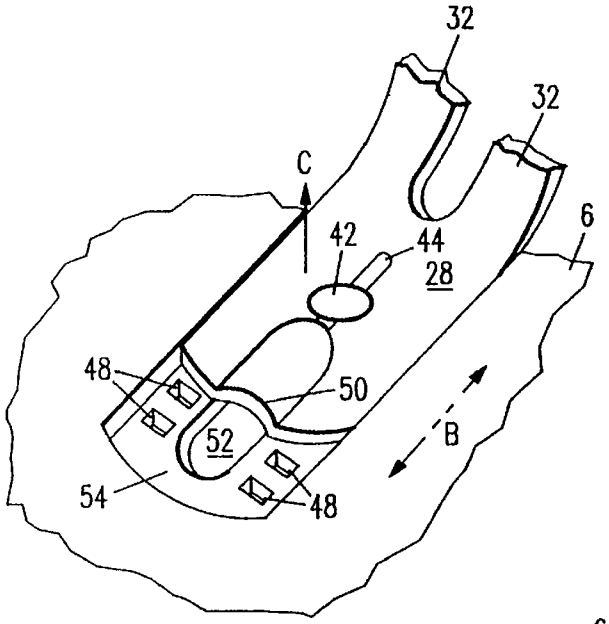

FIGS. 9*a* and 9*b* show one alternative embodiment for adjusting the position of the articulated member 14. Proximal end 28 is slidably attached to the interior surface 6 with a suitable fastener 42, such as a rivet, screw or split, plastic, flanged post. Fastener 42 passes through longitudinal slot 44 in the proximal end 28, thereby retaining the articulated member 14 on the main shell 2 while allowing it to slide in the longitudinal direction shown by arrow B.

A pair of tabs 46 protrude from proximal end 28 and each tab 46 engages a notch 48 to prevent the proximal end 28 from sliding. Two rows of notches 48 are provided, spaced laterally apart to accommodate the spacing of the two tabs. The notches 48 are spaced longitudinally, to provide alternative locking positions as the proximal end 28 is adjusted by sliding longitudinally. To allow the proximal end 28 to slide, the wearer is able to flex the proximal end 28 away from the main shell 2 in the direction of arrow C to momentarily disengage tabs 46 from notches 48. Once the proximal end 28 is slid in the direction of arrow B to a new position and released, the resilient force of the flexed proximal end 28 allows tabs 46 to engage with a new pair of notches 48.

Projection 50 in the proximal end 28 and hollow 52 in the interior surface 6 facilitate the wearer's ability to grasp the proximal end 28 for easy adjustment. The proximal end 28 can be located in a recess 54 in the interior surface 6 to provide greater comfort to the wearer and to longitudinally guide the proximal end 28 during adjustment.

FIG. 10 shows another alternative embodiment for adjusting the position of the articulated member 14. Proximal end 28 is slidably attached to the interior surface 6 with a pair of suitable fasteners 42, such as rivets, screw or split, plastic, flanged posts. Fasteners 42 passes through longitudinal slots 44 in the proximal end 28, thereby retaining the articulated member 14 on the main shell 2 while allowing it to slide in the longitudinal direction shown by arrow B.

A cutout 56 is provided in the proximal end 28 with a rack of teeth 58 located along an edge of cutout 56, having teeth spaced in a longitudinal direction. A pinion 60 is rotably mounted to the interior surface 6 within the cutout 56 such that it engages the rack of teeth 58. Pinion 60 can be rotated with a screwdriver, coin or the like to drive the proximal end 28 in a longitudinal direction.

Once adjusted, the proximal end 28 can be held in place by friction between the pinion 60 and interior surface 6 and/or friction between proximal end 28 and interior surface 6. Alternatively, the proximal end 28 can be locked down by tightening screw fasteners 42 after adjustment.

FIG. 11 shows yet another alternative embodiment for adjusting the position of the articulated member 14. Proximal end 28 is slidably attached to the interior surface 6 with a suitable fastener 42, such as a rivet, screw or split, plastic, flanged post. Fastener 42 passes through longitudinal slot 44 in the proximal end 28, thereby retaining the articulated member 14 on the main shell 2 while allowing it to slide in the longitudinal direction shown by arrow B.

Opposite sides of proximal end 28 are fitted with teeth 62 spaced in a longitudinal direction. Each of the two sets of teeth 62 engages a complementary rack of teeth 64 attached to the interior surface 6 of the main shell 2 to releasably prevent the proximal end 28 from moving. A pair of finger holes 66 and a pair of flexures 68 are both incorporated into the opposite sides of proximal end 28 for allowing the wearer to flex the two sets of teeth 62 inwardly towards each, as shown by arrows D, and out of engagement with the racks of teeth 64. In this manner, the wearer can slide the proximal end 28 longitudinally, as shown by arrow B. When inward pressure is released from the finger holes 66, flexures 68 urge teeth 62 outwardly back into engagement with racks of teeth 64, thereby locking the articulated member 14 into position after adjustment.

FIGS. 12*a* and 12*b* show yet another alternative embodiment for adjusting the position of the articulated member 14. Proximal end 28 is slidably attached to the interior surface 6 with a suitable fastener 42, such as a rivet, screw or split, plastic, flanged post. Fastener 42 passes through longitudinal slot 44 in the proximal end 28, thereby retaining the articulated member 14 on the main shell 2 while allowing it to slide in the longitudinal direction shown by arrow B.

A cutout 70 is provided through proximal end 28, having opposite sides formed by two racks of teeth 72, the teeth being spaced in a longitudinal direction. A complementary shaped, raised portion 74 is provided on the interior surface 6, partially filling cutout 70. Raised portion 74 is provided with teeth 76 on opposite sides for engagement with the two racks of teeth 72.

The raised portion has a longitudinal length that is shorter than that of cutout 70, so that the proximal end 28 may be alternatively adjusted and locked into a plurality of positions with respect to the main shell 2. To make such an adjustment, the wearer grasps the proximal end 28 at projection 50 and resiliently flexes the proximal end 28 away from interior surface 6, as shown by arrow C in FIG. 12*b*. This disengages the two racks of teeth 72 from teeth 76 and allows the wearer to move the proximal end 28 longitudinally, as shown by arrow B. When the projection 50 on the proximal end 28 is released after adjustment, a different portion of the two racks of teeth 72 are resiliently urged into engagement with teeth 76 on raised portion 74.

The proximal end 28 can be located in a recess 54 in the interior surface 6, as shown in FIG. 12*b*, to provide greater comfort to the wearer and to longitudinally guide the proximal end 28 during adjustment. Also, raised portion 74 and fastener 42 can be formed on a single plate 78 which is recessed when mounted on interior surface 6, as shown in FIG. 12*a* (or further recessed if used in conjunction with recess 54 in FIG. 12*b*).

Figure 13A:
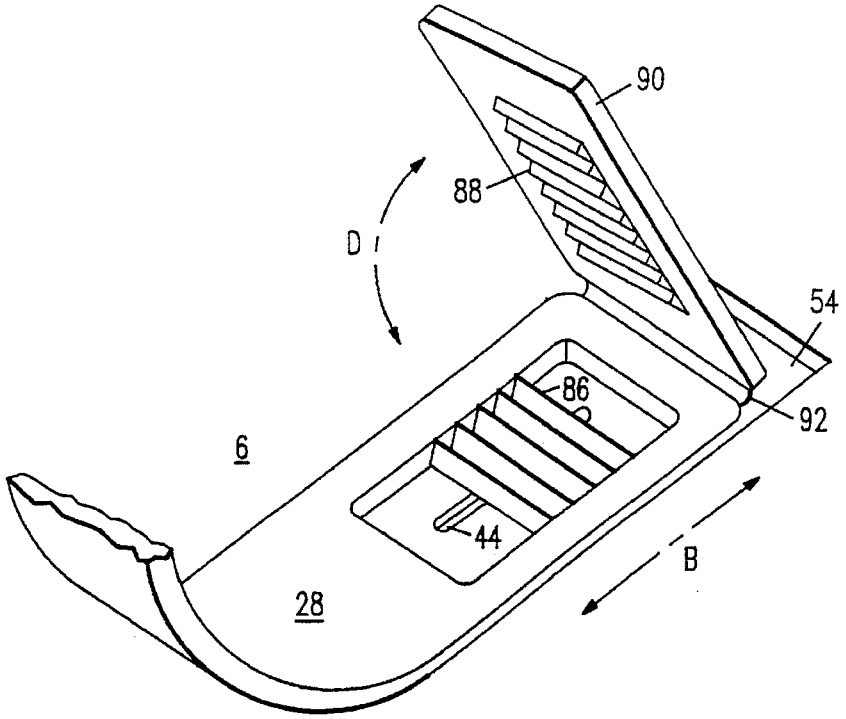
Figure 13B:
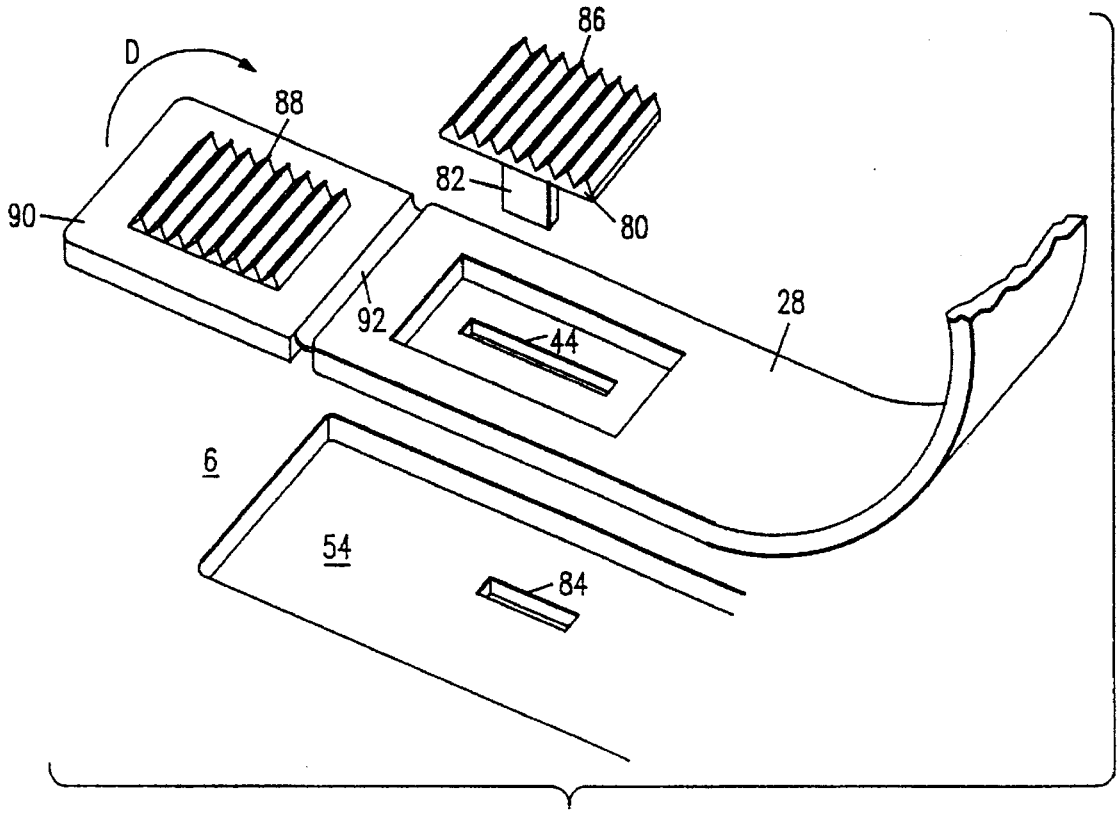

FIGS. 13*a* and 13*b* show yet another alternative embodiment for adjusting the position of the articulated member 14. Proximal end 28 is slidably attached to the interior surface 6 with a plate 80 and post 82 arrangement. Post 82 depends from plate 80 and passes through longitudinal slot 44 in the proximal end 28, and is received in slit 84 to attach the plate 80 to the interior surface 6, thereby retaining the articulated member 14 on the main shell 2 while allowing it to slide in the longitudinal direction shown by arrow B.

A plurality of ridges 86 are formed on plate 80 opposite post 82. A complementary set of ridges 88 is formed in flap 90, which is hingedly connected to proximal end 28 by a "living hinge" 92. Flap 90 may be folded back over onto proximal end 28, as shown by arrow D, and snapped into place, thereby engaging ridges 86 with ridges 88 and preventing proximal end 28 from movement. Adjustment is accomplished by unsnapping flap 90 to disengage ridges 88 from ridges 86, longitudinally sliding proximal end 28 to a new position, and snapping flap 90 back into position so that ridges 88 re-engage ridges 86.

Figure 14A:
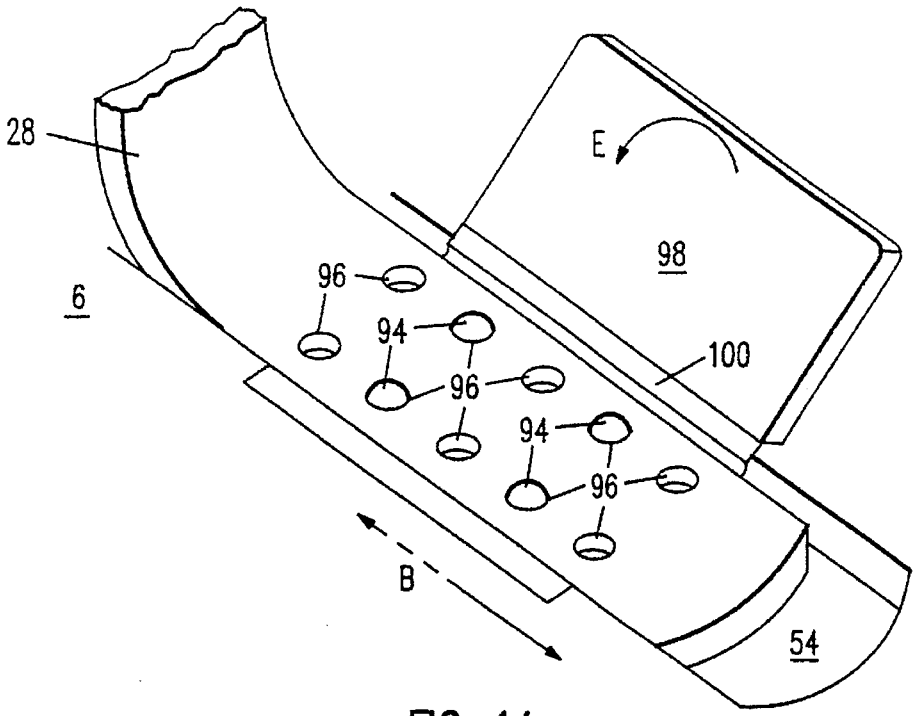

FIG. 14*a* shows yet another alternative embodiment for adjusting the position of the articulated member 14. Two pairs of laterally spaced posts 94 are spaced longitudinally apart on interior surface 6. A plurality of pairs of mating holes 96 are longitudinally spaced along the proximal end 28 and two pairs of holes 96 at one time receive the two pairs of posts 94 to prevent the proximal end from moving longitudinally. Flap 98 is hingedly connected to interior surface 6 by living hinge 100, and snaps over proximal end 28 to secure it on posts 94, as shown by arrow E. Adjustment is accomplished in a fashion similar to that described above for previous embodiments.

Figure 14B:
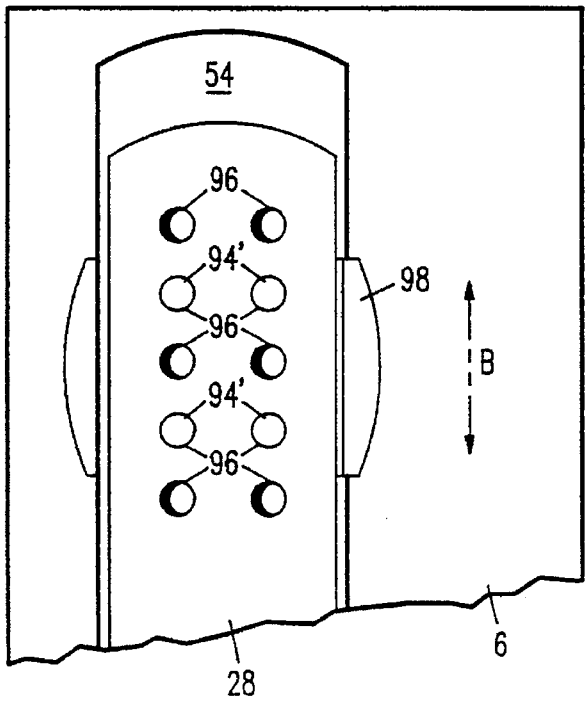

FIG. 14*b* shows one more alternative embodiment for adjusting the position of the articulated member 14. This embodiment is similar to that of FIG. 14*a*, but does not have a hingedly connected flap. Proximal end 28 is retained by posts 94', which have larger diameters at their distal ends than at their bases or than the diameters of the holes 96, thereby retaining proximal end 28 between the distal ends of posts 94 and the interior surface 6. This allows proximal end 28 of articulated member 14 to be unsnapped from posts 94', adjusted longitudinally, and snapped back onto the posts 94' with a different set of holes 96. Posts 94' can be formed on a plate 98, which is attached to main shell 2.

The general and alternate embodiments described above and shown in FIGS. 1 through 14 illustrate the general concept of the present invention. The preferred embodiment, as shown in FIGS. 15 through 17, is the intended design as it is envisioned for production, and operates substantially in an identical manner.

In the preferred embodiment, two straps 18' are used to connect the articulated member 14 to the main shell 2. Each strap 18' is connected to the articulated member 14 with a strap connector 102. Strap connectors 102 are plastic tabs that are ultra-sonically welded onto one end of elastic straps 18', and fit into and are retained by pockets 104 in the articulated member 14. The opposite ends of straps 18' are adjustably attached to patches 20 of VELCRO® hook and loop type fasteners glued inside the main shell 2. In the preferred embodiment, all of the force exerted by the articulated member 14 against the wearer's head is generated by the stretching of straps 18'. In the relaxed position when not being worn and with the straps 18' removed, the articulated member 14 rests against the inside of the rear of the helmet.

It is to be understood that the present invention is not limited to the sole embodiments described above and illustrated herein, but encompasses any and all variations falling within the scope of the appended claims.

What is claimed as the invention is:

1. A bicycle helmet comprising:

a dome shaped shell assembly having a front portion and a back portion substantially covering a top portion of a wearer's head and having opposite sides;

an inverted T-shaped articulated member depending from said back portion of said shell assembly, the articulated member having a lower distal end;

elastic means connecting said articulated member and said opposite sides of said shell assembly for allowing said distal end of said articulated member to extend rearward when the helmet is donned to provide a resilient forward pressure against an inwardly curved portion on the posterior of a wearer's head, thereby providing a more securely fitted helmet.

2. A bicycle helmet according to claim 1, wherein said shell assembly is substantially hemispherical and said elastic means biases the distal end of the articulated member upward and inward against a wearer's head.

3. A bicycle helmet according to claim 1, wherein the articulated member has a proximal end, and the shell assembly has a front half, a rear half, an interior surface and an exterior surface, further wherein the proximal end of the articulated member is attached to the central top interior surface toward the front of the rear half of the shell assembly forward of the back of the neck of a wearer.

4. A bicycle helmet according to claim 1, wherein the articulated member is inwardly curved in a longitudinal direction and the distal end of the articulated member is inwardly curved in a lateral direction, thereby forming a substantially spherical recess for receiving the occipital portion of a wearer's head.

5. A bicycle helmet according to claim 1, wherein the articulated member is slidably attached to the shell assembly to allow a wearer to adjust the position of the articulated member relative to the shell assembly, the helmet further comprising releasable locking means for releasably locking the articulated member in a fixed position relative to the shell assembly after position adjustment.

6. A bicycle helmet according to claim 5, wherein the slidable attachment adjustment only shifts the location of the articulated member vertically relative to the nape of a wearer's neck, and not the level of resilient forward pressure against a wearer's neck.

7. A bicycle helmet comprising:

a shell assembly substantially covering a top portion of a wearer's head and having a top portion for fitting over the top of a wearer's head, the shell assembly having a front half and a rear half and a lower edge, and having an interior surface partially defined by an interior curve in a longitudinal centerline plane, the shell assembly having a first side and having a second side laterally opposite to the first side;

a resiliently flexible, articulated member having a proximal end and a T-shaped distal end, the proximal end being attached to the top portion of the shell assembly substantially along said centerline plane toward the front of the shell rear half forward of the back of the neck of a wearer, the articulated member extending generally along the interior curve beyond the lower edge of the shell assembly to the distal end, the distal end contacting a lower portion of the occipital region of a wearer's head and imparting a resilient forward force thereto, the resilient forward force being generated as the articulated member is flexed rearward by a wearer's head; and first and second resiliently elongatable straps, the first strap resiliently connecting the distal end of the articulated member to the first side of the shell assembly, the second strap resiliently connecting the distal end to the second side, the first and second straps being elongated when the shell assembly is worn such that the distal end of the articulated member is urged upward and forward by the straps against a wearer's head, the first and second straps being adjustably connected to the shell assembly, thereby allowing a wearer to increase or decrease the amount the articulated member is urged against a wearer's head.

8. A bicycle helmet comprising:

a shell assembly substantially covering a top portion of a wearer's head and having opposite sides;

an articulated member depending from the shell assembly, the articulated member having a distal end;

resilient flex means for allowing the distal end of the articulated member to resiliently flex rearward when the helmet is donned to provide a resilient forward pressure against an inwardly curved portion on the posterior of a wearer's head, thereby providing a more securely fitted helmet;

said articulated member being slidably attached to an interior surface of the shell assembly to allow a wearer to adjust the position of the articulated member relative to the shell assembly; and releasable locking means for releasably locking the articulated member in a fixed position relative to the shell assembly after position adjustment;

said slidable attachment and said releasable locking means comprising rivet means for slidably attaching a proximal end of the articulated member to the shell assembly, said rivet means passing through a hole in a portion of the shell assembly and through a longitudinal slot in the proximal end, thereby retaining the articulated member on the shell assembly while allowing it to slide longitudinally;

at least one rack of teeth located longitudinally on said shell assembly;

at least one complementary shaped tooth located on said proximal end for releasably engaging the rack of teeth and preventing the proximal end from sliding longitudinally;

at least one flexure incorporated on said proximal end for allowing said complementary shaped tooth to be disengaged from said rack when a pressure is applied; and grip means for allowing a wearer to grip said proximal end, apply a pressure to operate said flexure and disengage said complementary shaped tooth, and slide the proximal end longitudinally.

9. A bicycle helmet comprising:

a shell assembly substantially covering a top portion of a wearer's head and having opposite sides;

an articulated member depending from the shell assembly, the articulated member having a distal end;

resilient flex means for allowing the distal end of the articulated member to resiliently flex rearward when the helmet is donned to provide a resilient forward pressure against an inwardly curved portion on the posterior of a wearer's head;

first and second elastically elongatable straps, each having a first end releasably attached to an opposite side of the shell assembly;

first and second tabs, each connected to a second end of one of the first and second straps; and first and second slots through the distal end of the articulated member, each receiving one of the and second straps but preventing the tabs from passing through, thereby providing a means to releasably secure the second ends of the first and second straps to the distal end of articulated member, the first and second straps providing additional resilient forward pressure against an inwardly curved portion on the posterior of a wearer's head.

10. A support device for retaining a bicycle helmet on the head of a wearer said helmet having a shell assembly with a front and a back substantially covering a top portion of the head of a wearer comprising:

(a) arcuate arm means for mounting on said back of the helmet so that the arm means extends downwardly beyond the bottom rear edge of the helmet;

(b) cross bar means on the bottom end of said arm means for engaging the back of the head of a wearer below the widest region of the head of a wearer; and (c) means for resiliently biasing said cross bar means against the back of the head of a wearer to restrict movement of the helmet on a wearer's head, said biasing means including strap means for connecting the distal end of said arm means to opposite sides of a helmet, said strap means being elastic to elastically bias said cross bar means against the back of the head of a wearer.

11. A bicycle helmet comprising:

(a) a shell assembly having a front portion and a back portion substantially covering the top portion of the head of a wearer;

(b) arcuate arm means for mounting on said back portion of the helmet so that the arm means extends downwardly beyond the bottom rear edge of the helmet;

(c) cross bar means on the bottom end of said arm means for engaging the back of the head of a wearer below the widest region of the head of a wearer; and (d) means for resiliently biasing said cross bar means against the back of the head of a wearer to restrict movement of the helmet on a wearer's head, said biasing means including strap means for connecting said cross bar means to opposite sides of the helmet, means being elastic to elastically bias said cross bar means against the back of the head of a wearer.

* * * * *

UNITED STATES PATENT AND TRADEMARK OFFICE

CERTIFICATE OF CORRECTION

PATENT NO.: 5,659,900
DATED: August 26, 1997
INVENTOR(S): MICHEL ARNEY ET AL.

It is certified that errors appear in the above-identified patent and that said Letters Patent is hereby corrected as shown below:

In Col. 1, line 24, change "no" to --to--
In Col. 3, line 4, add a --.-- following "particular wearer"
In Col. 4, line 57, change "Reliefs 36" to --Reliefs 36,--
In Col 10, line 4, add --first-- after "receiving one of the"
In Col. 10, line 50, add --said strap-- before "means being elastic"

Signed and Sealed this

Twenty-third Day of February, 1999

*Attest:*

Q. TODD DICKINSON

*Attesting Officer*

*Acting Commissioner of Patents and Trademarks*